US005131636A

United States Patent [19]

Marmann

[11] Patent Number: 5,131,636

[45] Date of Patent: Jul. 21, 1992

[54] LANCE HOLDER FOR A COMPACT LANCE

[75] Inventor: Horst Marmann, Ratingen, Fed. Rep. of Germany

[73] Assignee: Beda Oxygentechnik Armaturen GmbH, Ratingen, Fed. Rep. of Germany

[21] Appl. No.: 373,876

[22] Filed: Jun. 29, 1989

[30] Foreign Application Priority Data

Dec. 2, 1988 [EP] European Pat. Off. ..... 88120123

[51] Int. Cl.[5] ..... C21C 5/30

[52] U.S. Cl. ..... 266/287; 266/218; 266/225; 266/226; 266/270

[58] Field of Search ..... 266/218, 225, 226, 265, 266/270, 287

[56] References Cited

FOREIGN PATENT DOCUMENTS 2410678 8/1979 France ..... 266/225

730817 5/1980 U.S.S.R. ..... 266/226

*Primary Examiner*—R. Dean

*Attorney, Agent, or Firm*—Herbert Dubno; Ronald Lianides

[57] ABSTRACT

The lance holder for an oxygen lance has a substantially increased reliability and safety, since a valve disk slidable against the force of a valve disk spring by insertion of the lance is provided in a retaining body between the slag run back safety device and a gripping head. This valve disk is forced from the valve seat on insertion of the lance so that the refinery gas can pass through the lance holder without more. If through some error the lance is released, i.e. by slipping out from the holder, the valve disk automatically closes so that the oxygen gas provided can not flow through. A contact of the oxygen-supply hose with the lance holder attached to it is thus reliably prevented. At the same time the slag run back safety device and the clamping head are formed so that a very compact lance holder results.

11 Claims, 2 Drawing Sheets 12
13
3
8
7
9
10
14
11
27
26
30
29
20
33
28
2
22
21
34
18
24
19
1
31
32
15
36
23
35
37
41
38
44
39
49
48
5
43
47
4
40
46
6
45

LANCE HOLDER FOR A COMPACT LANCE

FIELD OF THE INVENTION

My present invention relates to a lance holder for an oxygen lance, especially a metal-refining lance, with a large diameter.

BACKGROUND OF THE INVENTION

A known lance holder for an oxygen lance comprises a retaining body, a gripping head to hold the lance fixed and a slag run-back safety device mounted in the retaining body of the lance holder between the lance and an oxygen-supply hose.

A lance holder with a suitable gripping head and a slag run-back safety device acts to hold the lance required for refining safely and to prevent slag run back on ending or interruption of the blowing process from reaching the oxygen-supply hose.

In the lance holder according to German Open patent application 23 27 595 a gas permeable disk made of sintered metal, which prevents the slag run back, is mounted just in front of the oxygen-supply hose. This mechanical closure for the slag run back is not satisfactory when comparatively large quantities of oxygen must be provided. Then the use of the sintered metal disk leads to problems depending on its nature.

Slag run back safety devices are also known which have valve cones movable relative to each other. In these safety devices the appropriate valve cone is pressed into a sealing surface when slag comes into contact with the valve cone to prevent the flow of slag.

Problems are also noted with these safety devices when the lance by error or by force is released or loosened so that the oxygen-supply hose end and the lance holder loaded with flowing oxygen can come into contact. Danger to operating personnel then exists. This is especially true for lances of large diameter in which the weight of the lance can result in an unsatisfactory securing of the lance by the gripping head and expose personnel to danger as mentioned above.

OBJECTS OF THE INVENTION

It is an object of my invention to prevent dangerous contact of the lance holder and a hose supplying gas, e.g. oxygen, to it when the lance is loosened.

It is another object of my invention to provide a lance holder for an oxygen lance, especially for a metal refining lance, having improved safety and reliability.

SUMMARY OF THE INVENTION

These objects and others which will become more readily apparent hereinafter are attained in accordance with my invention in a lance holder for an oxygen lance, especially for a metal refining lance.

According to my invention a valve disk movable against the spring force of a valve disk spring by the lance during insertion is provided in the retaining body between the gripping head and the slag run back safety device, which has a buffer sleeve fitting the diameter of the lance and protruding in the direction of the lance and which is supported on inclined sealing surfaces on a constriction of the inner passage in the retaining body which has a correspondingly inclined shoulder.

This surprisingly provides a lance holder, in which the oxygen feed is automatically stopped, when the lance erroneously falls from the lance holder.

When another charge is processed, the slag run back safety device is likewise more reliable and closes the oxygen-supply hose from the dangerous slag flow so that here no danger occurs.

Advantageously the oxygen feed can only be switched on and/or can be switched in effectively when the lance is correctly inserted in the lance holder, i.e. when the lance moves back the valve disk against the opposing spring force of the valve disk spring and then is secured by the gripping head.

This doubly reinforced safety counter the special dangers for the operator of a lance holder. Recoil occurring because of the flow of oxygen in the lance with comparatively large diameter and the higher oxygen flow rate can be compensated, especially with the lance released or lost.

The buffer sleeve can have an enlarged portion surrounding the lance on its end adjacent the lance and can be equipped with a buffer supported on the upper edge of a constriction outside between it and the constriction. This structure guarantees that the lance is fed in exactly centrally in the direction of the valve disk o being fed in through the gripping head so that the valve disk can be pushed out from its sealed position simultaneously.

The buffer, which can be covering part of the buffer sleeve, prevents the valve disk from being pushed back further than is required. With this system the operator can notice, on pushing in the lance, very quickly if the valve disk is pushed back and thus the feed of the oxygen has been opened. The buffer sleeve is somewhat shorter than the corresponding cavity and/or interior passage in the retaining body so that an appropriate signal reaches the operator by the appropriate impact.

Advantageously, the buffer can be formed on the buffer sleeve by a compressed coil spring whereby the uniform insertion of the lance and thus the buffer sleeve is attained without danger o tilting the valve disk.

Ease of assembly is provided by my invention since the valve disk and the buffer sleeve are detachably secured with each other by attachment screws. Thus the valve disk can be pushed from one side into the retaining body while the buffer sleeve is guided in from the other side. By attachment with the attachment screws a safe reliable arrangement is provided whereby the valve disk is loaded by a valve disk spring supported on or in the Seeger ring (C-clip or split ring). The appropriate screws can be reached from the outside without difficulty.

The spring loading the valve disk is clamped between the valve disk and a Seeger ring, as already mentioned In this way the mounting of the valve disk and the spring is facilitated and a reliable clamping results in continuous operation.

The response of the slag run back safety device has greater reliability, when, as my invention provides, a conical sieve and a threaded sieve pin of the slag run back safety device are attached to one another by a soldered joint which can be broken by the influence of slag and the sieve pin supports itself with a free end on the front valve cone.

Thus the direct action of the front valve cone is guaranteed, when the soldered joint is destroyed at a certain exact temperature.

The threaded sieve pin, which can be rotated for exact positioning of the front valve cone and thus for a suitable opening, slips through the soldered joint and the Seeger ring so that the valve cone can slide into the valve seat and then seal there.

Upon response of the slag run back safety device and/or the illustrated valve cones, next the gas flowing out is prevented by rapid closing of the valve cone. A complete closure between the lance holder and the oxygen-supply hose is optimally guaranteed since the slag run back safety device has a second rear valve cone slidable against a spring force relative to the first front valve cone.

Upon response of the front valve cone, the valve cone spring can automatically cause this valve to close, as soon as the pressure in the oxygen-supply hose abates, since the rear valve cone carries a somewhat weaker valve cone spring for that purpose. Then the slag run back safety device is reliably activated and there is no danger for operating personnel to be feared.

Both valve cones are guided optimally according to one suitable embodiment on response of the slag run back safety device, since they have a common guide mounted by screwing together the retaining body and the rear portion. By this guide both valve cones are guided positively under constraint into a valve seat so that a optimum rapid seal is attained.

The guide is formed so that it has a centrally positioned centering pin which is formed corresponding to a pair of valve cone sleeves provided in the valve cones. Both valve cones can thus slide on the centering pin for opening the valve and/or can be pressed into the valve seat. By fixing both housing portions with housing screws a uniform guiding of both valve members of the slag run back safety device is guaranteed.

An advantageous uniform flow of gas inside the lance holder is guaranteed since the buffer sleeve has wall openings radially at the same height or level as the valve disk. These wall openings have a sufficiently large cross section. The gas can thus on appropriate opening of the slag run back safety device flow back to them into the buffer sleeve and from there further into the lance to reach from there the metal The valve disk can be advantageously positioned between the gripping head and a threaded connector for the oxygen-supply hose when the slag run back safety device is eliminated.

My invention is characterized by a very reliable and safe operation which provides for all eventualities. Advantageously many safety features are optimized. A compact lance with minimal structural dimensions is attained. Because of the provided structure and features of the individual valves the very quick shutoff, reduced diameter and very reliable safe structure results.

BRIEF DESCRIPTION OF THE DRAWING

The above and other objects, features and advantages of my invention will become more readily apparent from the following description, reference being made to the accompanying highly diagrammatic drawing in which.

SPECIFIC DESCRIPTION

Figure 1:
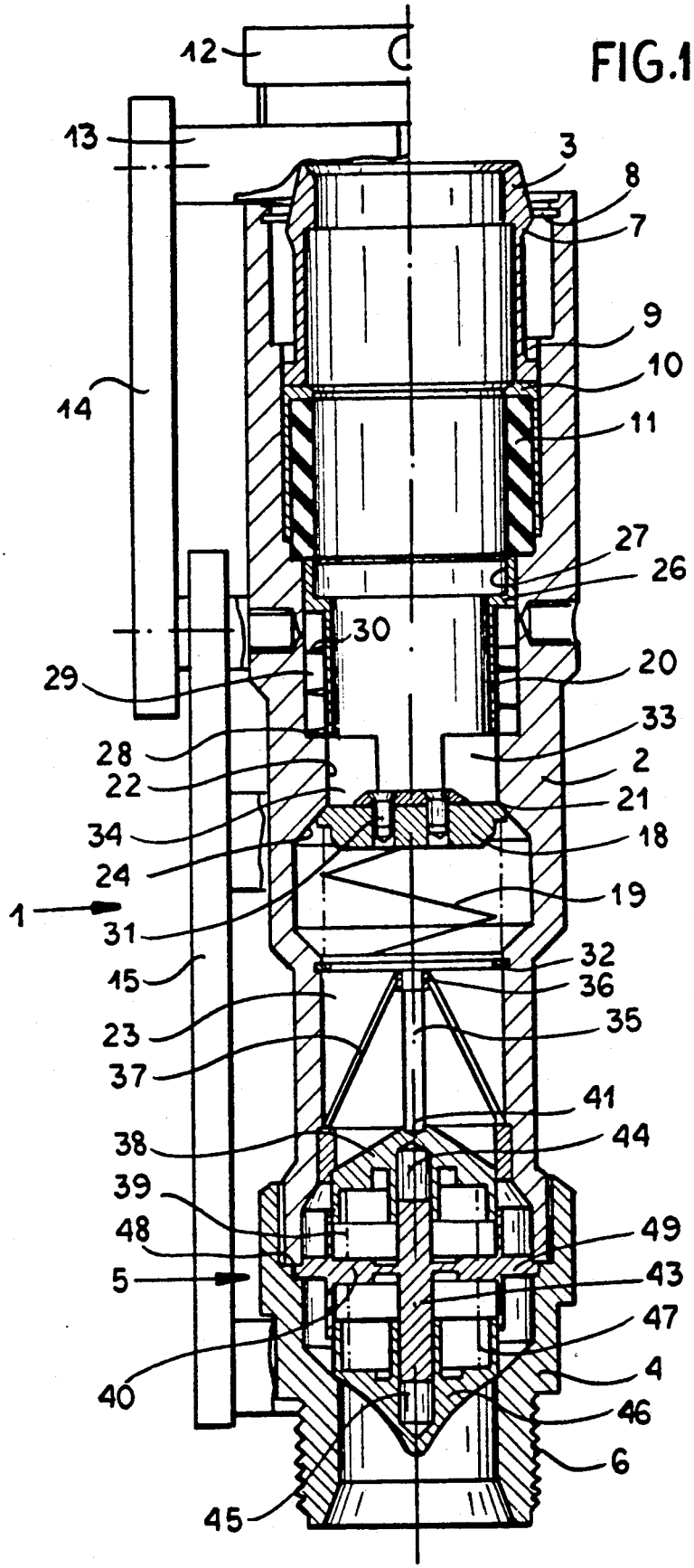
FIG. 1 is a longitudinal cross sectional view through a lance holder according to my invention.

The lance holder 1 shown in FIG. 1 can hold a lance 50 having a comparatively large diameter so that it can be connected with an oxygen-supply hose. The lance holder 1 has a pipe-like longitudinally extending retaining body 2 whose upper (front) end forms a gripping head 3 and whose lower (rear) end forms a rear portion 4, which is necessary for connection with the oxygen-supply hose. Inside the pipe-like retaining body 2, a slag backflow safety device 5 is mounted which is described in more detail below. The hose for the oxygen is connected to the threaded connector 6.

The lance holder 1 has clamp jaws 7 or a lance chuck which hold the corresponding pipe or lance fixed in or on the lance holder 1. An 0-ring 8 is provided sealing the top portion.

The lance holder 1 further comprises a threaded pin 9 and a sealing sleeve 10 in which a seal 11 is mounted which surrounds the lance when it is inserted and carries means for the necessary seals so that oxygen can not flow laterally from the lance.

The lance holder 1 also has a pressure sleeve 12 and a threaded ring 13. The lance holder 1 is tightened by the threaded ring 13 and by the tightening member 14 and the associated lever 15 to hold the lance tightly in the lance holder 1.

A valve disk 18 mounted approximately centrally in the lance holder 1, by which the passage through the lance holder 1, i.e. also its inner passage 23, is closed as is apparent from FIG. 1. The valve disk 18 is loaded by a valve disk spring 19 so that it is held sealed as mentioned earlier when a lance is not inserted. The valve disk 18 is attached to a buffer sleeve 20 and of course detachably by attachment screws 31 so that in this way the valve disk 18 may be displaced by the lance being inserted.

If a lance 50 is shoved into the buffer sleeve 20 and/or in the enlarged portion 27 formed on the upper end 26, the valve disk 18 is pushed from its contact with the sealing surfaces 21 on the constriction 22 by the buffer sleeve 20. The sealing surfaces 21 and the shoulder 24 are then no longer in contact so that the oxygen gas can issue from below without difficulty.

Figure 2:
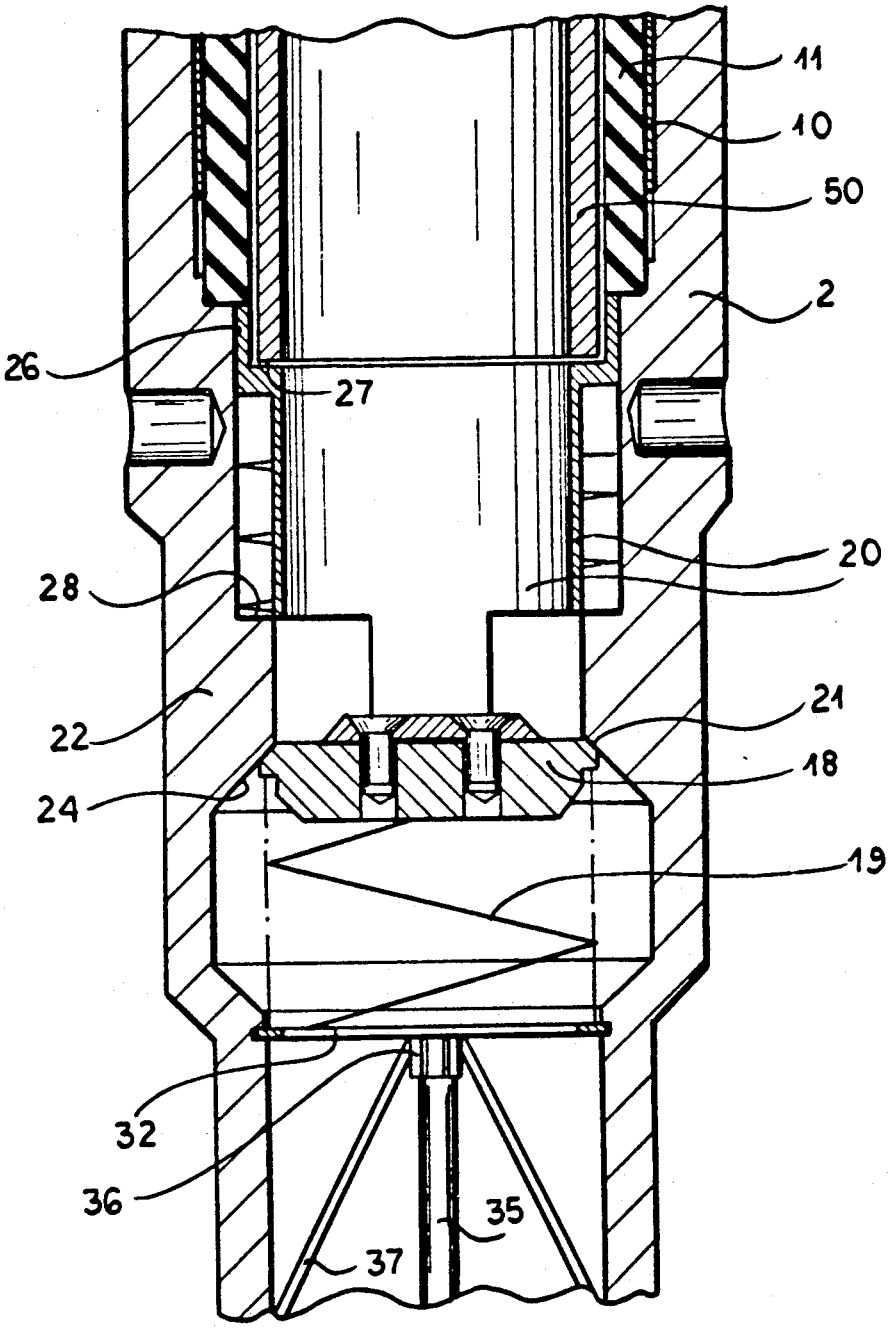
FIG. 2 is detail partly-broken-away longitudinal cross sectional view of the lance holder of FIG. 1 with a lance inserted.

In FIG. 2 it is apparent that both the sealing surfaces 21 and also the shoulder 24 are inclined so that a seal is attained when the valve disk 18 is seated.

The buffer sleeve 20 advantageously fits into the inside passage 23. A region is provided there in which the buffer 29 of the buffer sleeve 20 acts on the upper edges of the constriction 22 when an opening of the valve disk 18 is planned or intended by the lance 50. The buffer 29 is here formed as a compressed coil spring 30 which enables the lance to be inserted sufficiently far in the lance holder upon insertion thereof in the buffer sleeve 20 by increasing force from the operator.

The valve disk spring 19 of the valve disk 18 is supported on the far end from the valve disk 18 on a Seeger ring (C-clip) 32. This Seeger ring 32 is visible in both FIG. 1 and FIG. 2. It is inserted in a ring-like recess in the housing.

Wall openings 33, 34 are provided in the wall of the buffer sleeve 20 in the vicinity of the valve disk 18 to facilitate the flow of oxygen and/or the flow in the interior of the lance. The wall openings 33, 34 have a large cross section to feed sufficient quantities of oxygen through.

A threaded sieve 37 pin 35 is attached to a conical sieve by a soldered joint 36. The soldered joint 36 is formed and dimensioned so that on impingement by slag, a loosening of the threaded sieve pin 35 occurs so that a front valve cone 38, as can be seen in FIG. 1, springs into a correspondingly tight seat 38.1. Because of the conical sieve 37 it is thus guaranteed that the slag is stopped, at least until the soldered joint 36 is broken and then the closing process of the valve is initiated.

The front valve cone 38 is loaded by a valve cone spring 39 which is supported on an interior portion of the slag run back safety device 5. This slag run back safety device 5 has a guide 40 for the front valve cone 38, on which the free end 41 of the threaded sieve pin 35 acts and from the other end inside, the centering pin 43, which engages in the corresponding valve cone sleeve 44 in the front valve cone 38, and in another sleeve 45 in a rear valve cone 46.

When the outer ring 49 of the guide 40 is held fixed upon screwing together of the retaining body 2 and the rear portion 4, an exact guiding of both front and rear valve cones 38, 46 is guaranteed by the centering pin 43.

While the front valve cone 38 is loaded by the valve cone spring 39, another valve cone spring 47 acts to load the other rear valve cone 46. This other rear valve cone 46 is moved by the oxygen pressure, and the valve cone spring 47 is weaker than the first valve cone spring 39. This latter spring 39 must be forced in quickly and secures the front valve cone 38 on the valve seat 38.1. This process is assisted by the oxygen flowing out in the emergency.

The necessary seal is provided by an 0-ring 48 in the vicinity of this outer ring 49 so that here despite the oxygen present at a high pressure no gas can escape.

FIG. 2 shows the lance 50 mounted directly in the retaining body 2 and/or the lance holder 1. Still here the buffer sleeve 20 is not shown pushed in and correspondingly the valve disk is still shown in the closed position. If the lance now is pushed further, the valve disk 18 is pushed from the valve seat by the buffer sleeve 20.

Thus on feeding in oxygen and correspondingly pushing the rear valve cone 46 oxygen flows through the retaining body 2 and the lance 50.

If now the lance 50 pulls out from the lance holder 1 by error or by insufficient operation of the clamp jaws 7, thus the valve disk 18 follows because of the valve disk spring 19 loading the valve disk 18.

Thus the oxygen gas feed ends immediately and a contact of the lance holder and the hose or hose is prevented reliably, which can be very dangerous with lance holders with large cross sections.

When I refer to the "front" in the following claims I mean the side closest the top portion of the apparatus as seen in FIG. 1 (i.e. the top of the FIG.). By "rear" I mean the side closest the bottom of the FIG. (or the apparatus in the FIG.). By the "upper edges" of the constriction I mean the edges closest the top portion of apparatus—i.e. the front edges.

I claim:

1. In a lance holder for an oxygen lance for metal refining, comprising a retaining body, a gripping head for holding said lance fixed and a slag run back safety device mounted in said retaining body of said lance holder between said lance and an oxygen-supply hose, said retaining body having an inner passage, the improvement wherein a valve disk movable against the spring force of a valve disk spring by said lance during insertion is provided in said retaining body between said gripping head and said slag run back safety device, said retaining body further provided with a buffer sleeve fitting the diameter of said lance and protruding in the direction of said lance and supported on inclined sealing surfaces on a constriction of said inner passage in said retaining body, said constriction being formed with a correspondingly inclined shoulder.

2. The improvement defined in claim 1 in which said buffer sleeve has an enlarged portion surrounding said lance on an end facing or adjacent said lance and is provided with a buffer supported on the upper edges of said constriction outside off said buffer sleeve between said constriction and said enlarged portion.

3. The improvement defined in claim 1 in which said buffer comprises a compressed coil spring on said buffer sleeve.

4. The improvement defined in claim 1 in which said valve disk and said buffer sleeve are detachable secured with each other by a plurality of attachment screws.

5. The improvement defined in claim 1 in which said valve disk spring loading said valve disk is clamped between a Seeger ring and said valve disk.

6. The improvement defined in claim 1 in which said lance holder is provided with a front valve cone and said slag run back safety device is provided with a threaded sieve pin and a conical sieve, said threaded sieve pin and said conical sieve being connected with each other by a soldered joint breakable under the influence of slag and a free end of said threaded sieve pin being supported on said front valve cone.

7. The improvement defined in claim 6 in which said slag run back safety device has another rear valve cone slidable by spring force relative to said front valve cone.

8. The improvement defined in claim 7 in which said valve cones have a common guide mounted by screwing together said retaining body and said rear portion.

9. The improvement defined in claim 8 in which said guide has a centrally located centering pin, which is formed corresponding to a pair of valve cone sleeves associated with said valve cones.

10. The improvement defined in claim 1 in which said buffer sleeve has a plurality of radial wall openings in the vicinity of said valve disk.

11. A lance holder for an oxygen lance for metal refining, comprising:

a retaining body;

a gripping head holding said lance fixed;

a slag run back safety device mounted in said retaining body of said lance holder between said lance and an oxygen-supply hose for said lance, said retaining body having an inner passage, a buffer sleeve further provided in said retaining body and fitting the diameter of said lance and protruding in the direction of said lance and is supported on inclined sealing surfaces on a constriction of said inner passage in said retaining body formed with a correspondingly inclined shoulder, said buffer sleeve having an enlarged portion surrounding said lance on an end facing or adjacent said lance and being equipped with a buffer supported on the upper edges of said constriction outside of said buffer sleeve between said constriction and said enlarged portion, said buffer comprising a compressed coil spring on said buffer sleeve, said slag run back safety device further comprising a threaded sieve pin and a conical sieve, said threaded sieve pin and said conical sieve being connected with each other by a soldered joint breakable under the influence of slag;

a valve disk movable against the spring force of a valve disk spring by said lance during insertion thereof provided in said retaining body between said gripping head and said slag run back safety device, said valve disk and said buffer sleeve being detachably secured with each other and said valve disk spring loading said valve disk, said valve disk spring clamped between a Seeger ring and said valve disk; and a front valve cone, and a rear valve cone slidable by spring force relative to said front valve cone, a free end of said threaded sieve pin being supported on said front valve cone, said valve cones having a common guide held in place by screwing together said retaining body and said rear portion and having a centrally located centering pin, which is formed corresponding to a pair of valve cone sleeves associated with said valve cones.

* * * * *